United States Patent [19]

Guppy

[11] 4,308,697

[45] Jan. 5, 1982

[54] FLOOR PLATE ASSEMBLY

[75] Inventor: David W. Guppy, Poole, England

[73] Assignee: Loewy Robertson Engineering Co., Ltd., Poole, England

[21] Appl. No.: 118,228

[22] Filed: Feb. 4, 1980

[30] Foreign Application Priority Data

Feb. 2, 1979 [GB] United Kingdom ..... 03808/79

[51] Int. Cl.[3] ..... B65G 11/00

[52] U.S. Cl. ..... 52/64; 14/71.7; 49/33; 49/373; 104/31

[58] Field of Search ..... 14/71.1, 71.7, 71.3, 14/71.5, 69.5; 108/63; 52/64; 49/114, 109, 104, 207, 373, 374, 143, 168, 33; 104/31

[56] References Cited

U.S. PATENT DOCUMENTS

| | | | |
|---|---|---|---|
| 3,367,067 | 2/1968 | Noll | 49/104 |
| 3,439,451 | 4/1969 | Jung | 49/33 |
| 4,224,709 | 9/1980 | Alten | 14/713 |

FOREIGN PATENT DOCUMENTS

| | | | |
|---|---|---|---|
| 1241639 | 8/1971 | United Kingdom | 49/33 |

*Primary Examiner*—John E. Murtagh

*Attorney, Agent, or Firm*—Schwartz & Weinrieb

[57] ABSTRACT

A floor plate assembly, particularly suitable for use in and around rolling mills, comprises a closure floor plate which is arranged to close an opening adjacent another floor plate. The closure floor plate can move as required between a first position closing the opening and a second position under the other floor plate. The other floor plate is movable during the opening and closing operation to avoid obstruction of the closure floor plate.

10 Claims, 2 Drawing Figures

FLOOR PLATE ASSEMBLY

FIELD OF THE INVENTION

This invention relates to a floor plate assembly and is particularly, but not exclusively, applicable to those floor plate assemblies to be found in and around rolling mills and the heavy industrial environments.

BACKGROUND OF THE INVENTION

Much of the area surrounding a rolling mill is provided with rails, runways and tracks to facilitate the shifting of, for example, mill rolls, coil cars and the like. Generally these rails and tracks are below the normal level of the workshop floor in order to accommodate the working position of such rolls, cars, etc.

Safety precautions demand that, when the rails and tracks are not in use for shifting the mill components, removable floor plates must be provided. However, in some cases, for example, where coil cars carrying coils of strip from the delivery end of the rolling mill stand to suitable conveying and storage facilities it is necessary that there be an opening in the floor area to accommodate that part of the coil car that extends upwardly through floor level. Thus an open area of floor approximately equal to the width of the coil car and extending for the length of travel of the car is present in such cases and there are periods during maintenance procedures, and indeed during initial erection of the mill, when there is a danger of workmen falling through the opening into the void below.

OBJECTS OF THE INVENTION

It is an object of the invention to provide a floor plate assembly which can close an opening in a floor when necessary and which can be readily moved into and out of position.

It is a further object of the invention to provide a readily movable floor plate assembly for closing when required an opening along which travels the coil car of a rolling mill.

These and further objects of the invention will appear from the following description and claims.

SUMMARY OF THE INVENTION

The invention resides in a first movable floor plate, which is movable from and to an operative position; a closure floor plate which is mounted for movement between a first position in which it closes an opening in the floor adjacent the operative position of the movable floor plate and a second position in which it is disposed under the movable floor plate; and connecting means operative between the closure floor plate and the movable floor plate such that, during the movement of the closure plate from the first to the second position, the movable plate is moved from its operative position to avoid obstruction of the closure plate and is then returned to its operative position.

DESCRIPTION OF THE PREFERRED EMBODIMENT

Figure 1:
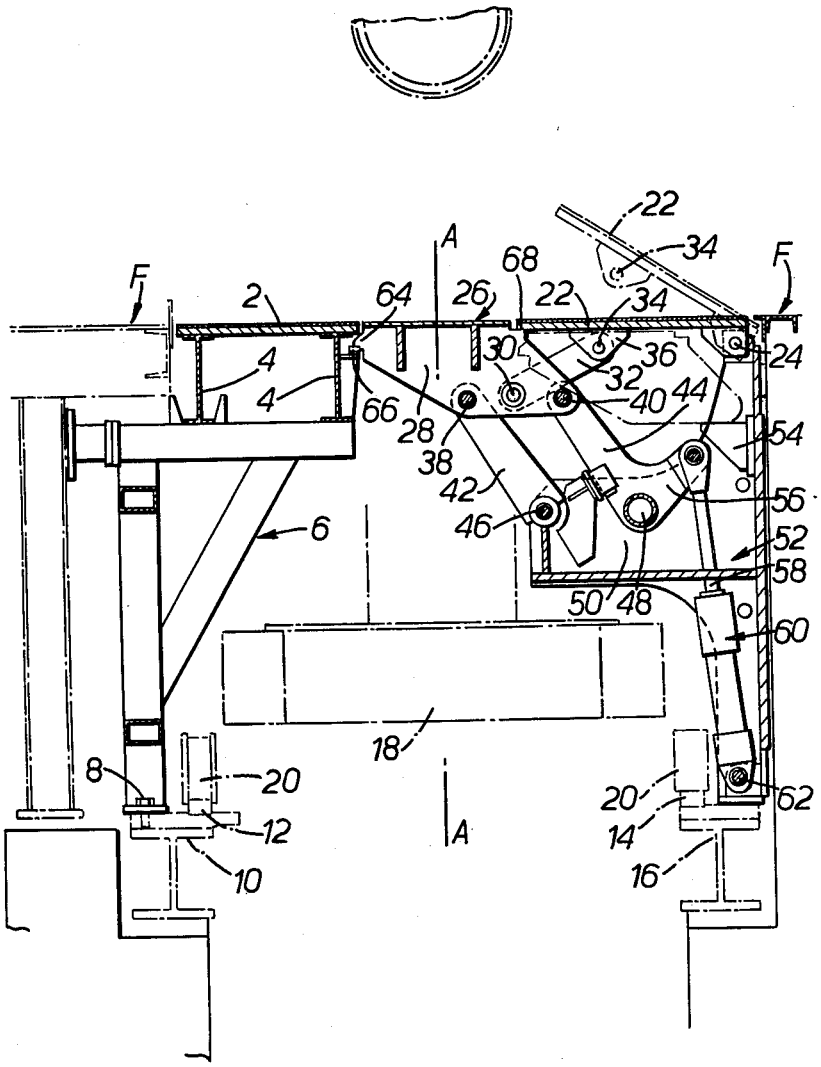
FIG. 1 is a section through part of the floor area in the vicinity of a rolling mill showing the floor plate assembly.
Figure 2:
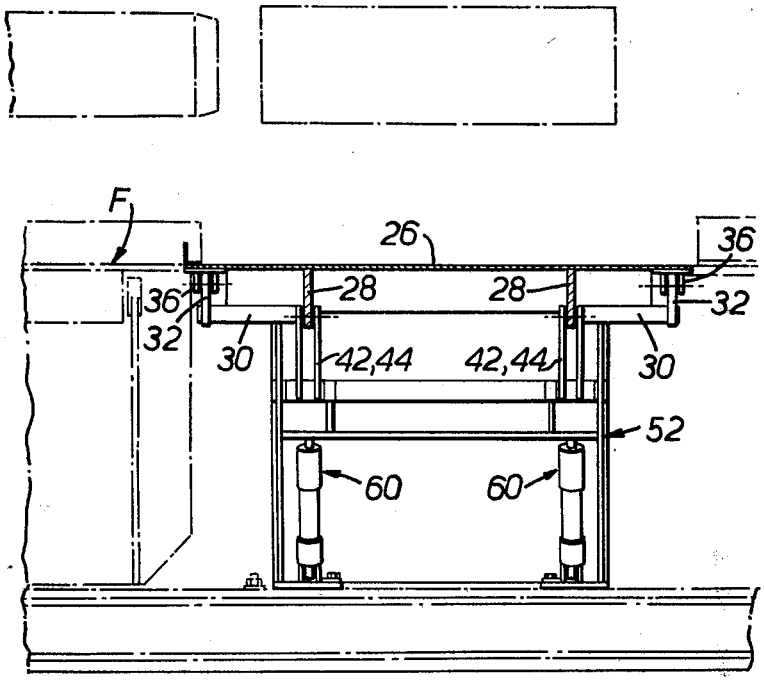
FIG. 2 is a section on enlarged scale through the mill floor area taken at right-angles to FIG. 1.

In FIG. 1, F denotes the floor level in the vicinity of a rolling mill stand (not shown). A fixed floor plate 2 is secured on girders 4 mounted on structural steelwork 6 in the underfloor area to the left of the centre line A—A of the rolling mill. The structural steelwork 6 is secured by bolts 8 to a girder 10 which carries a rail 12. A further rail 14 is carried by a girder 16 within the underfloor area, and above these rails a coil car 18, shown in chain dot lines, is movable on its wheels 20.

To the right of the centre line A—A of the mill a second floor plate 22 is pivoted about aligned pins 24 for a purpose which will be described.

A closure plate 26 is provided to safely bridge the opening between floor plates 2 and 22 when required so to do, and that plate 26 has downwardly dependent ribs 28. Aligned pivot pins 30 pass through those ribs 28 and pivoted on those pins at their lowermost ends are links 32, which are in turn pivoted at their upper ends on pins 34 mounted in lugs 36 on the underside of the floor plate 22.

The ribs 28 of closure plate 26 also carry aligned pins 38, 40, to which are pivoted the upper ends of pairs of links 42, 44 respectively. These links form together a parallel linkage system and are pivoted at their lower ends on their pins 46, 48 secured in ribs 50 which are part of an underfloor structure 52. The structure 52 also carries the aforementioned pins 24 and a pair of stop plates 54.

Each link 44 is formed as a bell crank by a depending arm 56 to which is pivotally connected the piston rod 58 of a piston and cylinder unit 60 which is mounted on a pin 62 secured in the underfloor structure 52. Retraction of the piston and cylinder units 60 causes the links 42, 44 to rock in a clockwise direction about their pivot pins 46, 48. In so moving, the closure plate 26, by virtue of its pin connections 38, 40, is caused to move from the closed position shown in FIG. 1 to a second, retracted position below the floorplate 22 and to the right of the centre line A—A of the mill, the ribs 28 then resting on the stop plates 54.

The first portion of the movement of the closure plate 26 causes the link 32, through its pivotal connections 30, 34, to raise the floor plate 22 about its pivot pins 24 to that position shown in chain lines in FIG. 1, so as to avoid obstruction of the movement of the closure plate 26 by the plate 22. During the latter part of the movement, that is, as the closure plate 26 is reaching its below-floor-level position, the plate 22 descends once more to its normal operative position shown in full lines in FIG. 1.

When the closure plate 26 is in its operative position, a shoulder 64 on the rib 28 rests on a stop 66 provided on the girders 4. At the same time the underside of the lefthand end portion of the floor plate 22 rests on a shoulder 68 formed on each rib 28. In the retracted position, when the closure plate 26 is disposed below the floor level, the underside of the plate 22 rests on the upper surface of the closure plate 26.

During the return movement of the closure plate 26 to its closed position, the plate 22 is again raised from its operative position to permit the return movement of plate 26 and is finally caused to return to its operative position shown.

It will be readily understood that other mechanisms can be employed to cause synchronised movement of the closure plate 26 and floor plate 22. Thus for example plate 22 need not pivot out of the way of closure plate 26 during movement of the closure plate to its retracted position. Instead the movable plate 22 may be arranged, for example, to move on vertical or horizontally disposed guide rails, out of the way of the retracting closure plate 26.

Likewise, the closure plate 26 is not necessarily caused to retract via a parallel linkage system such as that shown. Any suitable means may be employed and the closure plate 26 may be moved substantially horizontally instead of along an arcuate path by actuating means connected, for example, directly to the ribs 28 of the closure plate.

The piston and cylinder units 60 may be replaced by other suitable actuating means, such as a screw jack arrangement.

Obviously, many modifications and variations of the present invention are possible in light of the above teachings. It is therefore to be understood that within the scope of the appended claims, the present invention may be practiced otherwise than as specifically described herein.

I claim:

1. A floor plate assembly comprising:

a floor structure having an opening therein;

a first movable floor plate movable to and from an operative position adjacent the opening;

a closure floor plate;

means for moving the closure floor plate between a first position in which it closes the opening and a second position in which it is disposed under the movable floor plate; and connecting means operative between the closure floor plate and the movable floor plate such that, during the movement of the closure floor plate from the first position to the second position or from the second position to the first position, the movable floor plate is caused to move from its operative position, and is then returned to said operative position, in response to said movement of said closure floor plate whereby obstruction of the movement of said closure floor plate between said first and second positions, by said movable floor plate, is avoided.

2. The floor plate assembly of claim 1 in which the closure floor plate is mounted on a linkage system.

3. The floor plate assembly of claim 2, comprising:

downwardly dependent portions on said closure floor plate; and pairs of parallel links, pivoted at their upper ends to said portions and at their lower ends to said floor structure.

4. The floor plate assembly of claim 3, wherein the means for moving the closure floor plate are connected to the linkage system.

5. The floor plate assembly of claim 4, wherein the means for moving the closure floor plate comprises a hydraulic piston and cylinder unit.

6. The floor plate assembly of claim 5, wherein one of the links of the linkage system is formed as a bell crank, one end of which is connected to the movable arm of the piston and cylinder unit.

7. The floor plate assembly of claim 1, wherein the movable floor plate is pivotable from its operative position.

8. The floor plate assembly of claim 1, wherein the connecting means comprises links pivoted at one end to downwardly dependent ribs on the closure plate and pivoted at the opposite end to means depending downwardly from the movable floor plate.

9. The floor plate assembly of claim 1, wherein in its operative position closing the opening, the closure floor plate has at one side of the plate means for engaging an adjacent fixed floor section and at the other side of the plate means for supporting the free side portion of the movable floor plate.

10. The floor plate assembly of claim 1, wherein the closure floor plate is arranged to close, when required, an opening along which travels a coil car of a rolling mill.

* * * * *